US008534099B2

(12) United States Patent
Wheeler et al.

(10) Patent No.: US 8,534,099 B2
(45) Date of Patent: Sep. 17, 2013

(54) SINGLE AND MULTI-POINT DOOR LOCK

(75) Inventors: Thomas J. Wheeler, Pomona, CA (US); William Chung-Sum Chow, Rowland Heights, CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 263 days.

(21) Appl. No.: 12/803,585

(22) Filed: Jul. 1, 2010

(65) Prior Publication Data

US 2012/0000257 A1 Jan. 5, 2012

(51) Int. Cl.
*E05B 65/08* (2006.01)
*E05C 1/04* (2006.01)

(52) U.S. Cl.
USPC ..... 70/100; 70/107; 70/108; 70/451; 292/32; 292/42

(58) Field of Classification Search
USPC ..... 70/95–100, 137, 139, 107–111, 370, 70/451, 461, 373, 374, 417; 292/32, 33, 292/37, 39, 42, 280
See application file for complete search history.

(56) References Cited

U.S. PATENT DOCUMENTS

| | | | | | |
|---|---|---|---|---|---|
| 1,664,984 | A | * | 4/1928 | Lanphere | 70/107 |
| 2,781,656 | A | * | 2/1957 | Guzman | 70/136 |
| 2,989,859 | A | | 6/1961 | Eads | |
| 3,172,280 | A | * | 3/1965 | Cohen | 70/100 |
| 3,479,851 | A | | 11/1969 | Davidson et al. | |
| 3,659,445 | A | * | 5/1972 | Eads et al. | 70/451 |
| 3,697,107 | A | * | 10/1972 | Krantz | 292/337 |
| 3,740,979 | A | * | 6/1973 | Crepinsek | 70/139 |
| 3,899,906 | A | * | 8/1975 | Bradstock | 70/139 |
| 4,130,306 | A | * | 12/1978 | Brkic | 292/5 |
| 4,154,070 | A | * | 5/1979 | Bahry et al. | 70/108 |
| 4,218,903 | A | * | 8/1980 | Eads | 70/107 |
| 4,239,268 | A | * | 12/1980 | Rider | 292/5 |
| 4,368,905 | A | * | 1/1983 | Hirschbein | 292/5 |
| 4,387,918 | A | * | 6/1983 | Dunphy et al. | 292/224 |
| 4,593,546 | A | * | 6/1986 | Allen | 70/380 |
| 4,658,611 | A | * | 4/1987 | Deacon | 70/360 |
| 4,976,122 | A | * | 12/1990 | Doolan et al. | 70/134 |
| 5,148,691 | A | | 9/1992 | Wallden | |
| 5,495,731 | A | * | 3/1996 | Riznik | 70/108 |
| 6,217,087 | B1 | * | 4/2001 | Fuller | 292/39 |

(Continued)

FOREIGN PATENT DOCUMENTS

| | | |
|---|---|---|
| GB | 690247 | 4/1953 |
| GB | 1414273 | 11/1975 |
| WO | 2006/119486 | 11/2006 |

OTHER PUBLICATIONS

Copenheaver, Blaine R., "International Search Report," for application PCT/US2011/041049, filed Jun. 20, 2011, mailed Nov. 2, 2011, Alexandria, Virginia.

*Primary Examiner* — Lloyd Gall
*Assistant Examiner* — Myles Throop
(74) *Attorney, Agent, or Firm* — Woods Oviatt Gilman LLP

(57) ABSTRACT

In a lock drive train, the combination includes a pivoted lock bolt to be carried by a door, a casing, a rotary cylinder operatively rotatable during door opening or closing, a rack driven endwise in response to cylinder rotation, a gear rotatable by the driven rack, a pivoted lock dog driven by the gear, a bolt release lever, pivotable by the gear, between angular positions in which it is retained by the lock dog, the angular positions corresponding to extended and retracted positions of the bolt.

12 Claims, 12 Drawing Sheets

(56) References Cited

U.S. PATENT DOCUMENTS 6,283,516 B1 9/2001 Viney
2003/0159478 A1* 8/2003 Nagy ..... 70/107
2006/0130543 A1* 6/2006 Alchin et al. ..... 70/100
2007/0113603 A1* 5/2007 Polster ..... 70/107
2009/0078011 A1* 3/2009 Avni ..... 70/486

* cited by examiner

FIG. 4
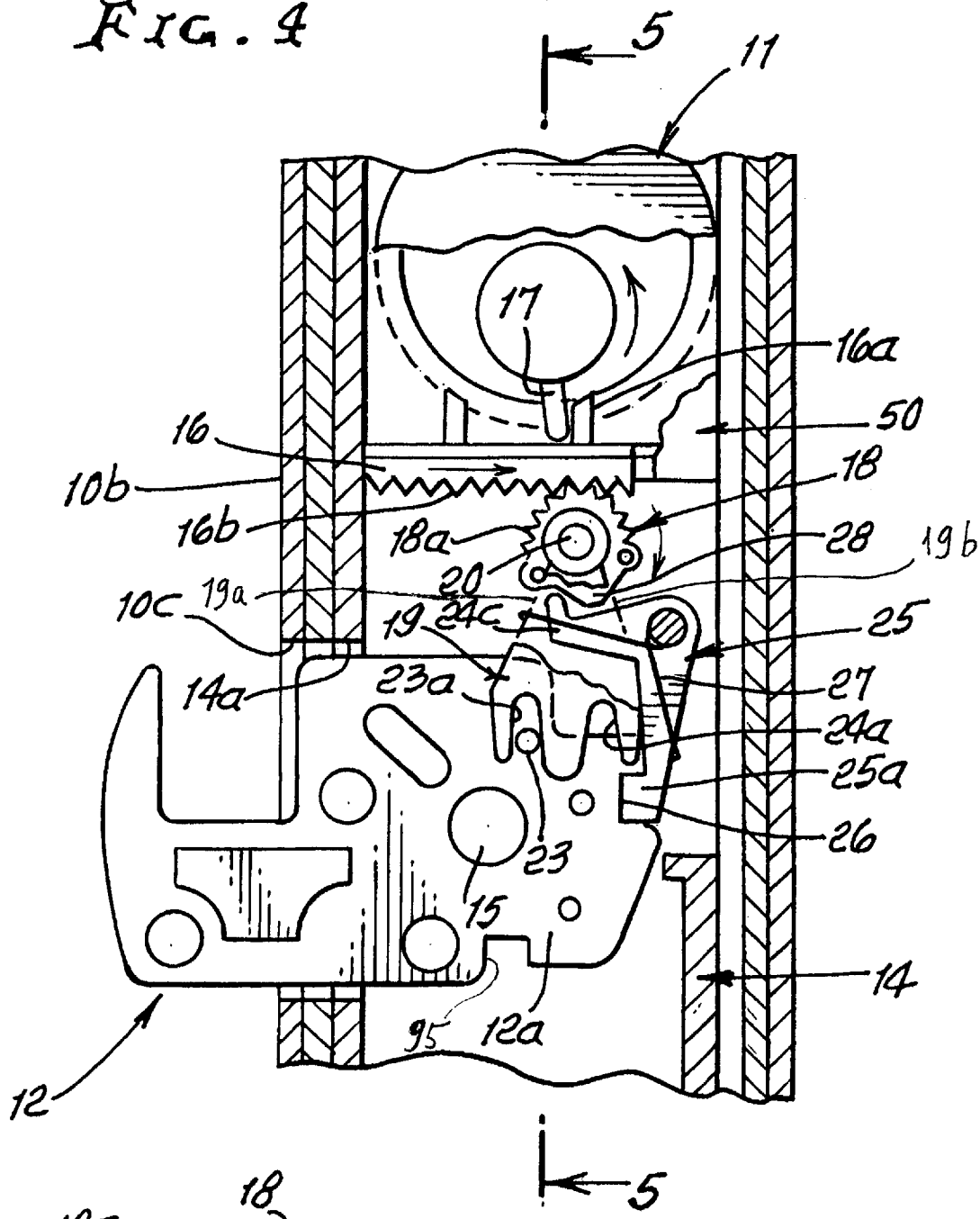
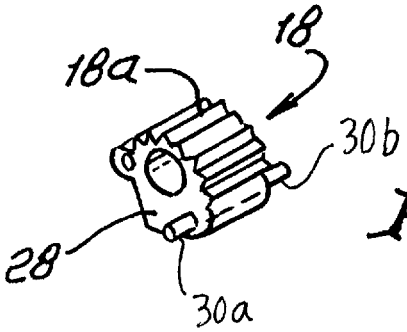
FIG. 5a

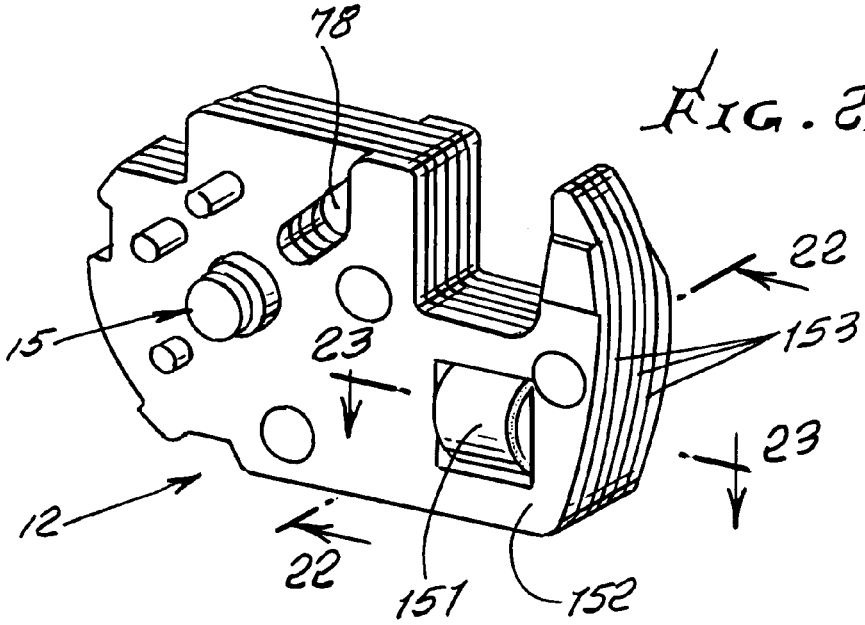
FIG. 21
FIG. 22
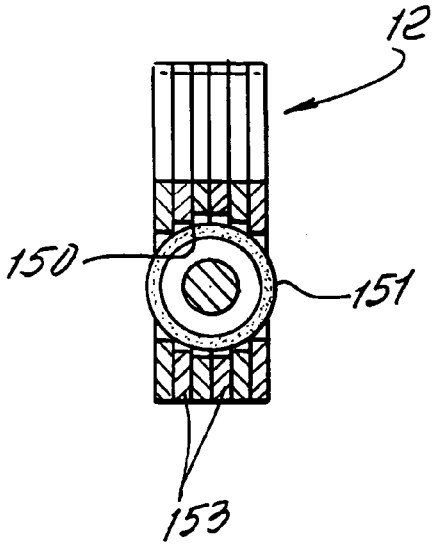
FIG. 23
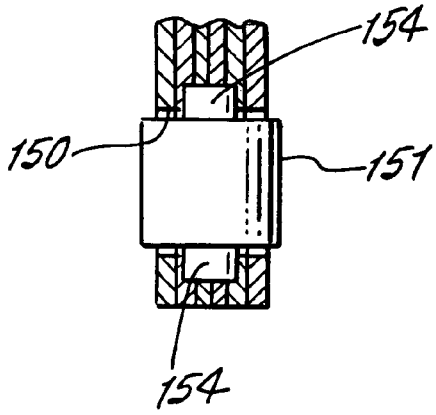

SINGLE AND MULTI-POINT DOOR LOCK

BACKGROUND OF THE INVENTION

This invention relates generally to single and multi-point locking apparatus for doors, and more particularly to a highly advantageous apparatus incorporating a simple, reliable, element drive train between an adjustable position manually rotatable lock cylinder, and pivoted lock bolt.

There is need for improvements in simple, reliable apparatus as referred to, and which is easily installed and adjustable in door frame structures. There is also need for the unusually effective and reliable combination of lock elements as is disclosed herein.

SUMMARY OF THE INVENTION

It is a major object of the invention to provide improved apparatus, meeting the above needs. Basically, the apparatus comprises a lock drive train comprising:

a) a pivoted lock bolt to be carried by a door, b) a casing, c) a rotary cylinder operatively rotatable during door opening or closing, d) a rack driven endwise in response to cylinder rotation, e) a gear rotatable by the driven rack, f) a pivoted lock dog driven by the gear, g) a bolt release lever, pivotable by the gear, between angular positions in which it is retained by the lock dog, h) said angular positions corresponding to extended and retracted positions of the bolt.

As will appear, the lock dog typically has releasable interfit connection with the bolt, in bolt extended and retracted positions, there being a lost motion connection between the gear and the bolt release lever whereby said interfit is released during gear rotation and prior to said pivoting of the release lever. In addition, spring means is provided to bias the lock dog to retain said releasable interfit, in bolt extended and retracted positions.

Another object is to provide a gear as referred to, which has multiple functions in the drive train, as respects both driving the bolt release lever, with lost motion connection; and also driving the lock dog in timed relation to the lost motion drive of the bolt release lever. The latter typically has pin and slot interconnection to the bolt.

A further object is to provide an improved pivotable bolt having a through opening between opposite sides of the bolt, and a roller received in that opening to protrude at opposite sides of said body, i) for rollable engagement with a confinement surface or surfaces associated with the casing, during bolt pivoting, ii) or, for engagement by a hack saw operated by an intruder, for blocking severing of the bolt.

An added object is to provide a lock cylinder having multiple threads, and a casing housing the cylinder and configured to be mounted within an opening in a door, and including a non-cantilevered locking set screw received in engagement with said threads.

A yet further object is to provide a lock faceplate having beveled edges interfitting corresponding edges defined by an opening in the casing, the faceplate being removable to provide access to said set screw, for adjustment.

Another object includes provision of a bolt that has at least one tapered side surface to assure ease of interfit in the casing, as the bolt pivots.

An additional object is to provide an elongated stile containing the casing, and spacers installed and located within the stile in response to relative sliding, for positioning the casing, said spacers configured to be adjustable during installation in the field, to retain the casing positioning in the stile, and a removable trim facing plate for the casing to conceal such spacers.

A further object is to provide a dummy face plate on the stile used during said adjustable positioning, to allow spacer alignment and positioning via a tool insertable in an opening or openings in the dummy face plate, that dummy face plate then being removable to allow installation of said final trim face plate.

Another object is to provide a casing for the rotary cylinder, to fit in a door opening, and means to retain the casing in any of a plurality of selected horizontal positions in the door opening. Such means may typically comprise a first set of tongue and groove elements at the door opening, and being horizontally spaced, and at least one tongue or groove element or elements carried by the cylinder casing or door opening, to selectively interfit said first set.

Yet another object includes provision of a stile into which the lock casing is received, and means for adjusting the position of the casing relative to a stile wall, including a set screw carried by the lock casing and having threaded engagement with the casing whereby the screw exerts tightening force against the stile, the screw rotatable by an elongated adjuster inserted and projecting into the casing.

A yet further object includes provision of upper and lower elongated rod elements extending into the lock casing to be operatively connected to the lock bolt for extension as the bolt rotates, and upper and lower auxiliary bolts operatively connected to said rod elements at their terminals, to be displaced into door frame structure as the lock bolt is pivoted. In this regard, adjustable means is typically operatively connected between the upper auxiliary bolt and the upper rod, allowing vertical adjustment of upper bolt positioning in response to rod rotation, and fastener means to hold the adjustment means in position following adjustment. The rod elements are configurable for both 2 and 3 point configurations.

An additional object is to provide an improved lock having quick connect and/or disconnect capabilities.

These and other objects and advantages of the invention, as well as the details of an illustrative embodiment, will be more fully understood from the following specification and drawings, in which:

DRAWING DESCRIPTION

FIG. 4 is a view like part of FIG. 2, showing elements in enlarged configuration;

Figure 2:
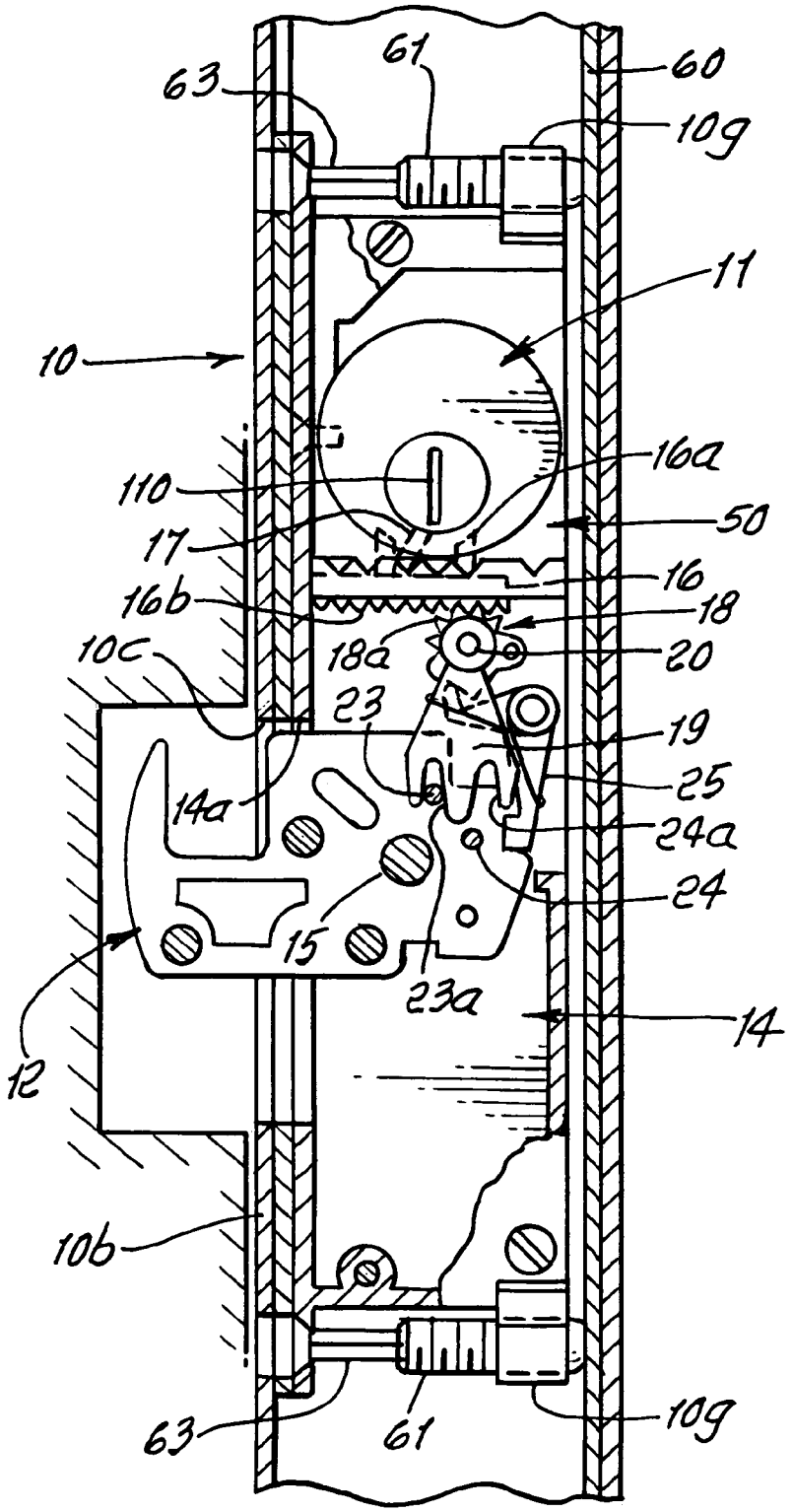
FIG. 2 is a vertical section taken through the FIG. 1 apparatus, and showing a blocked condition.
Figure 6:
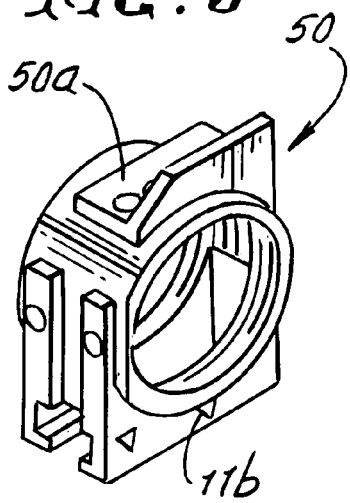
Figure 7:
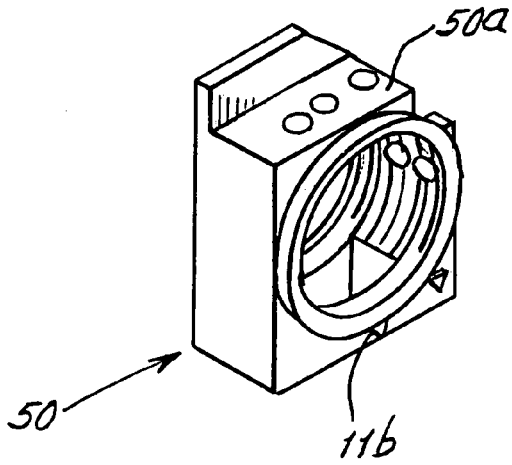
Figure 10:
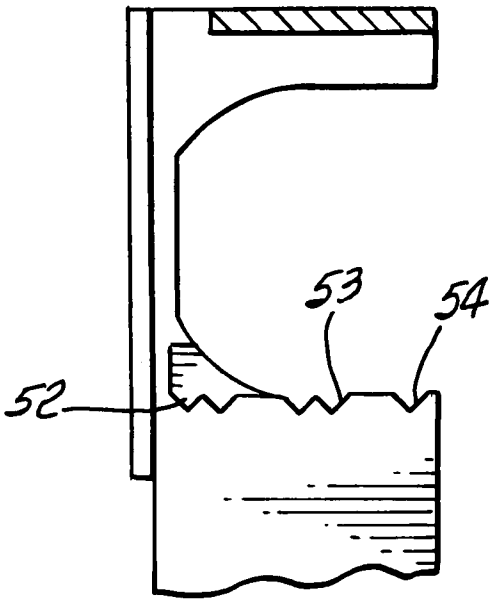
Figure 8:
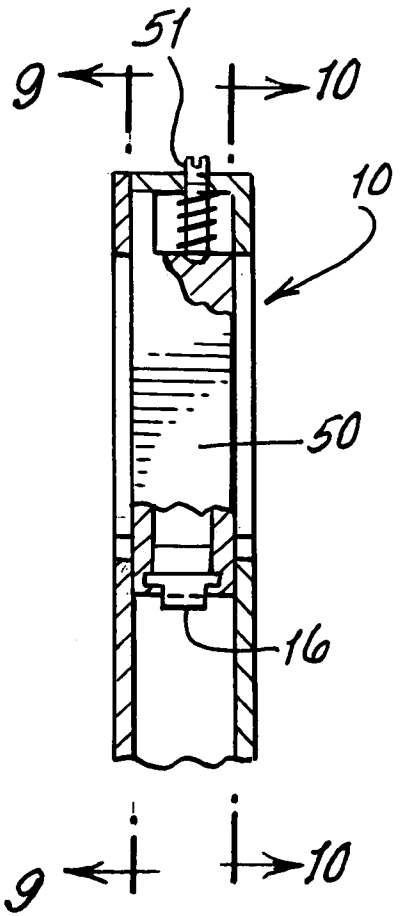
Figure 9:
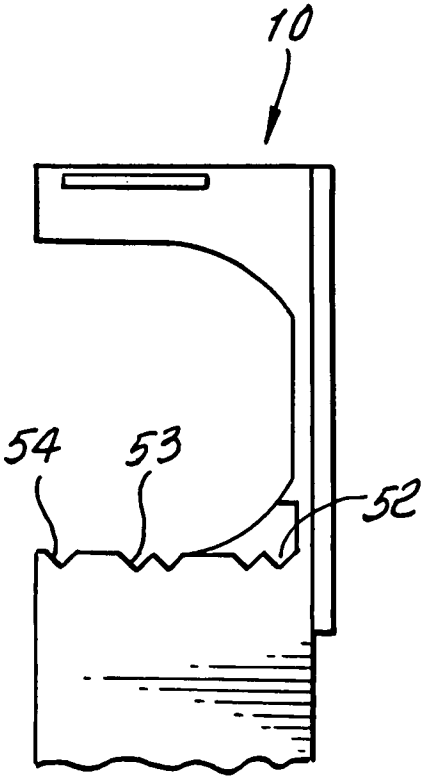
Figure 11C:
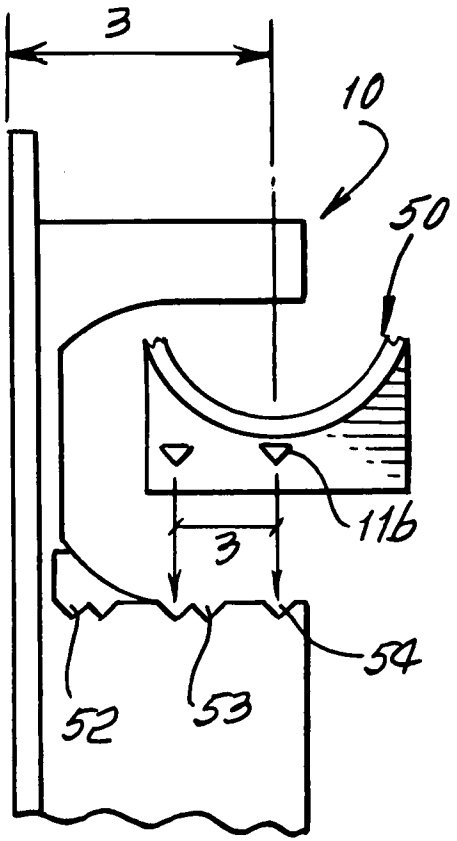
Figure 11B:
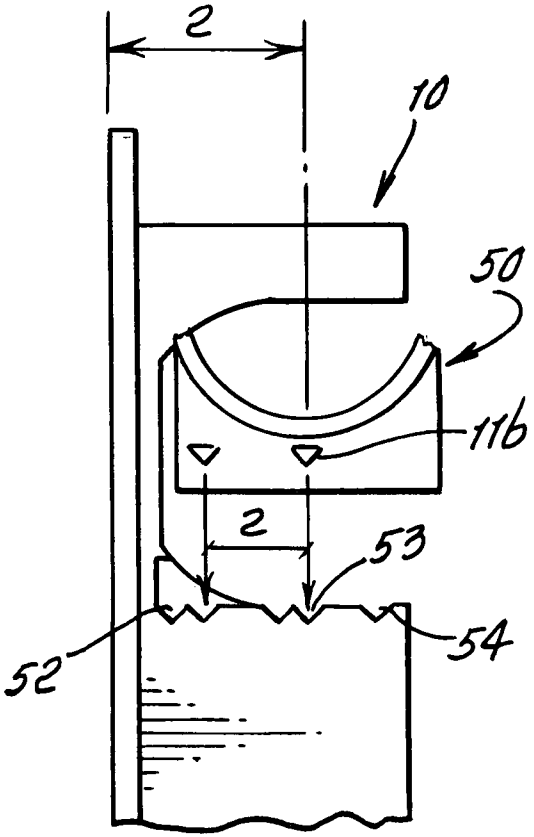
Figure 11A:
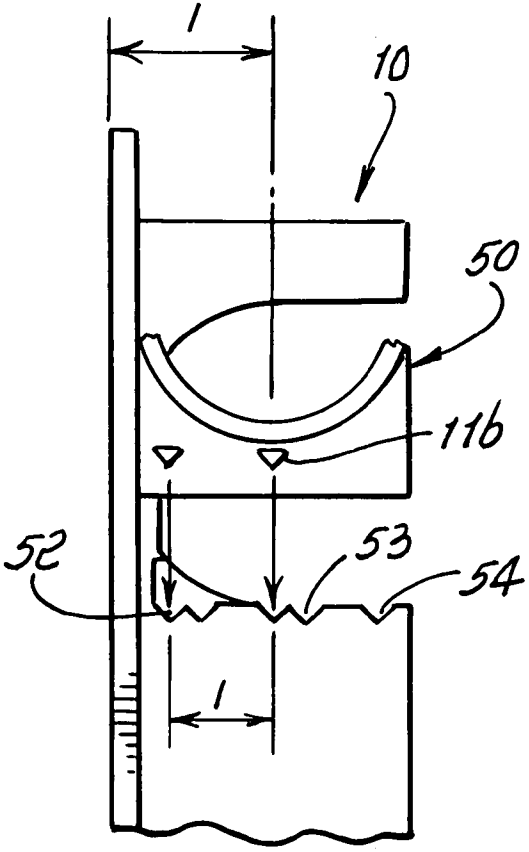
Figure 12:
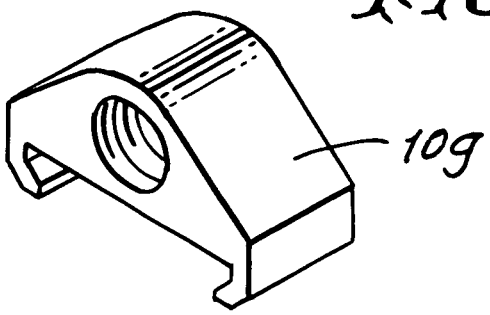
Figure 13:
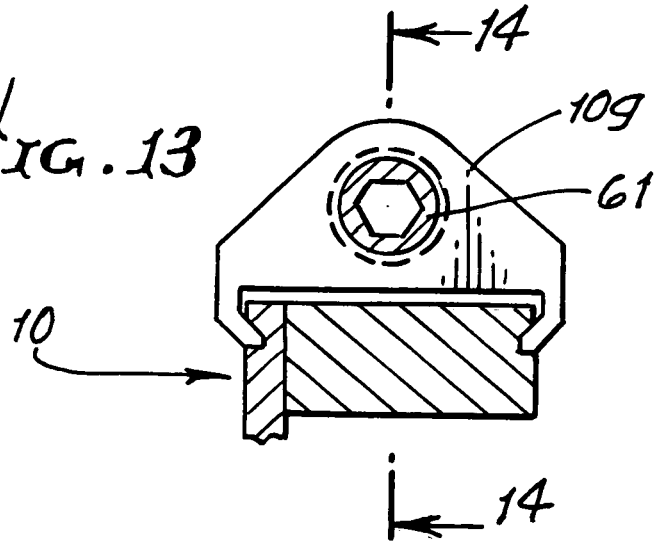
Figure 14:
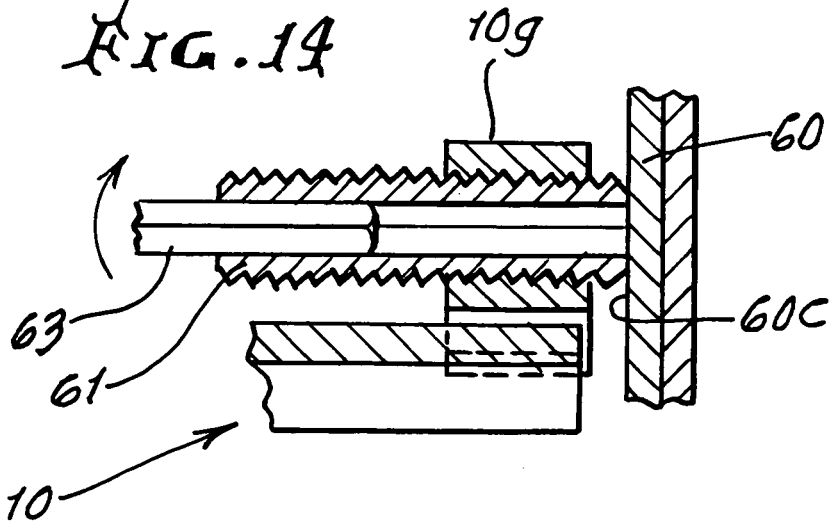
Figure 15:
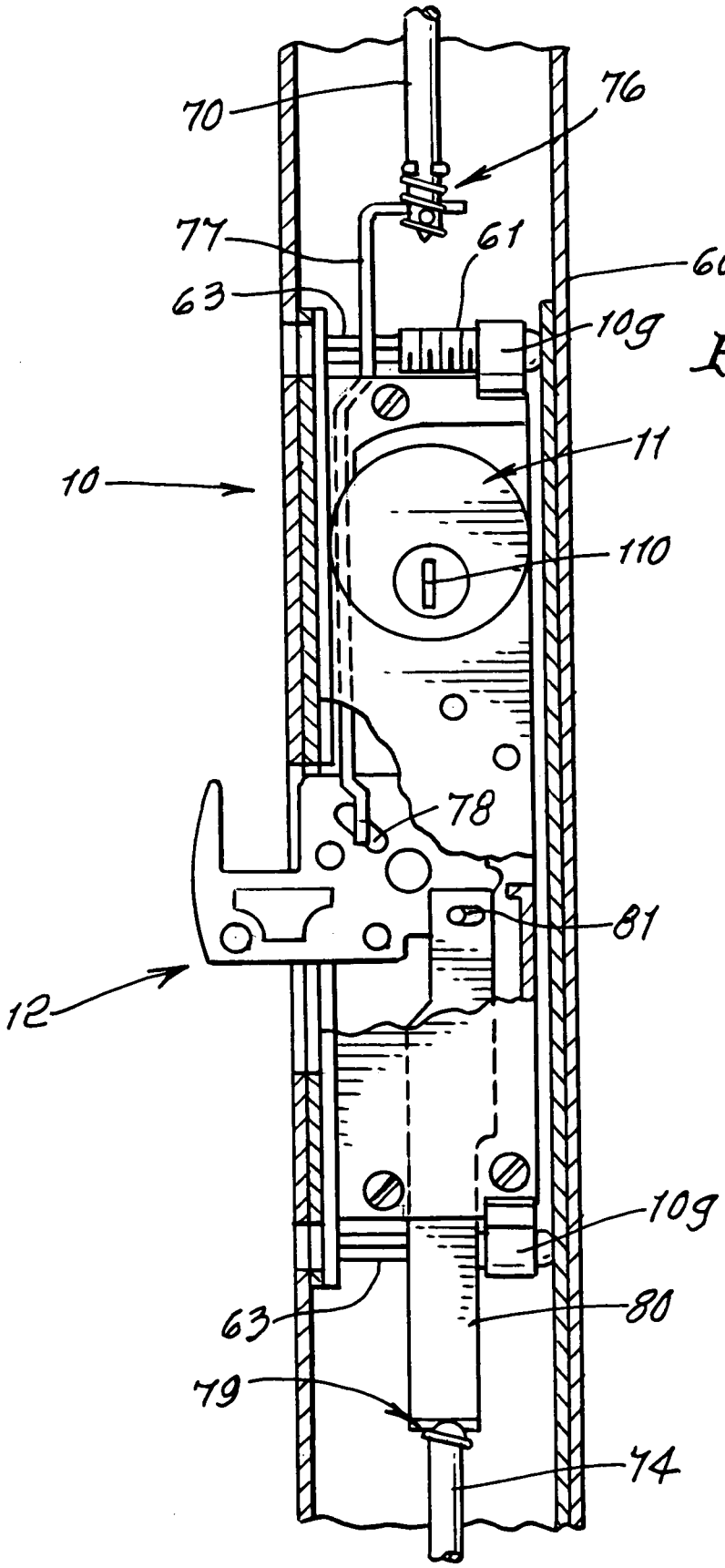
Figure 17:
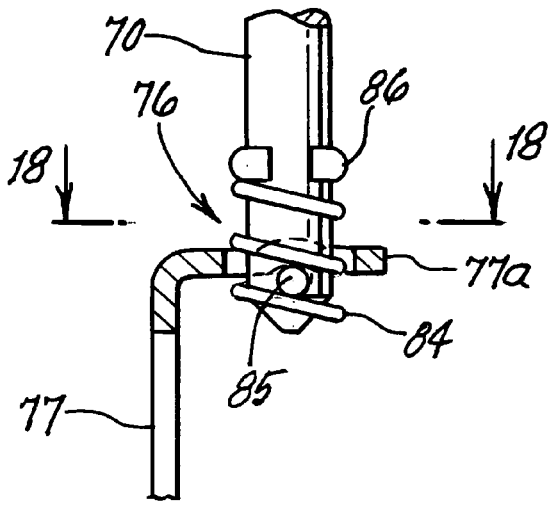
Figure 18:
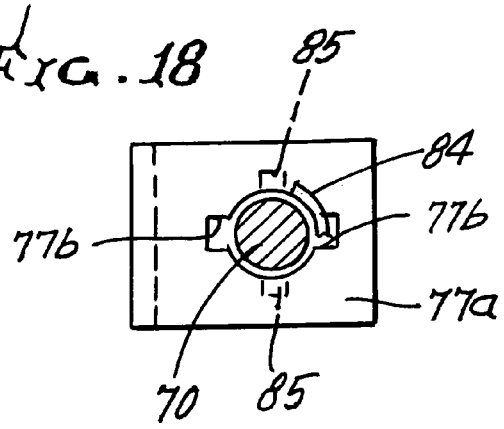
Figure 16:
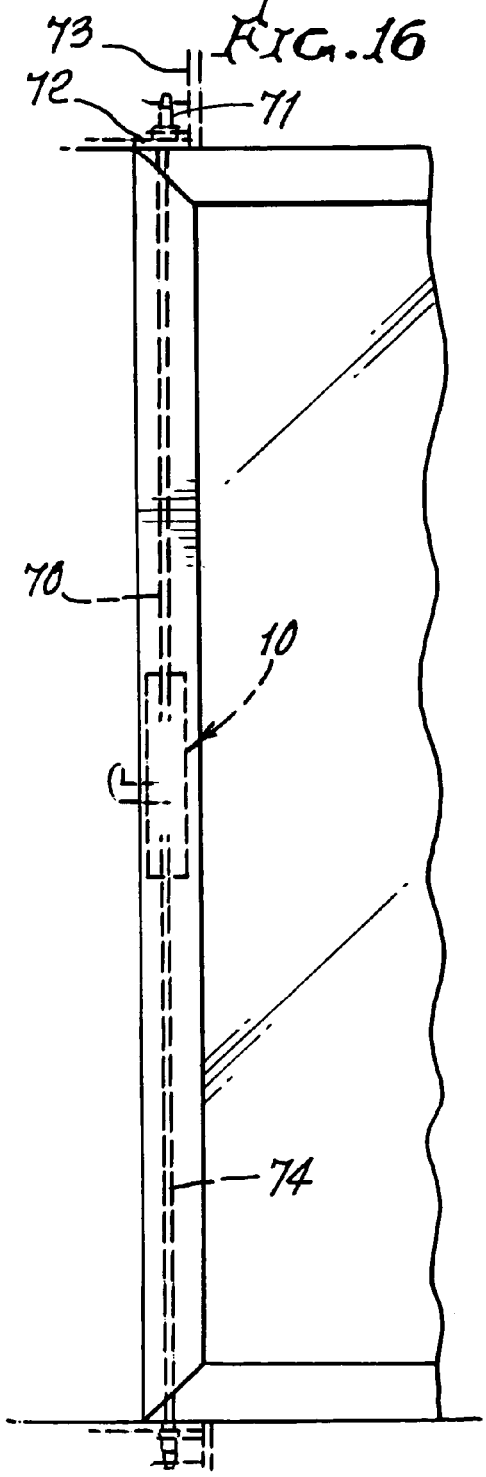
Figure 19:
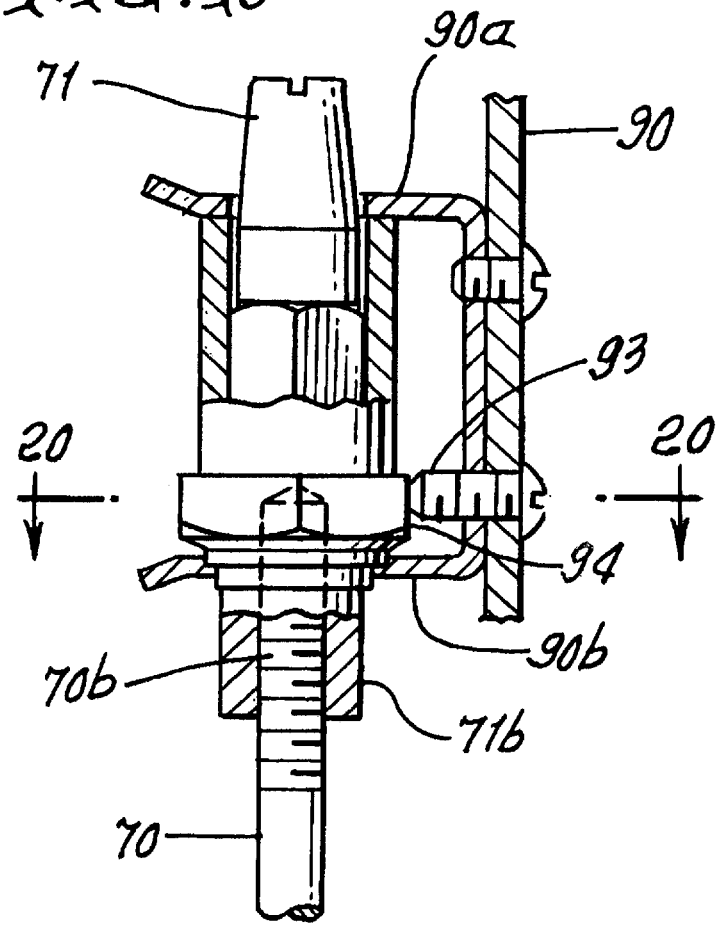
Figure 20:
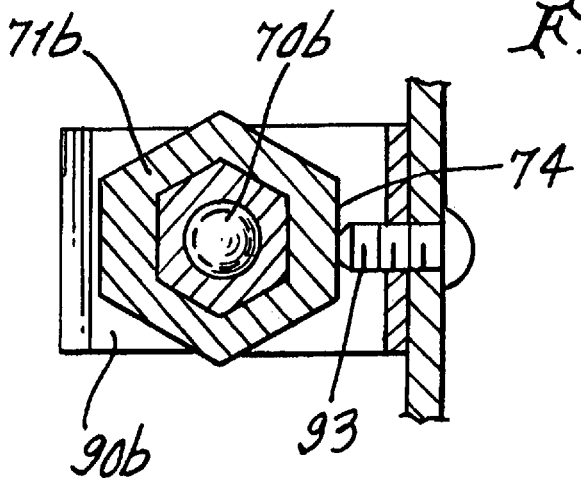

FIG. 5*a* is a perspective view showing of a pinion drive element;

FIG. 6 is a perspective view showing of a lock cylinder element showing one end thereof;

FIG. 7 is a perspective view showing the cylinder case element, endwise reversed from FIG. 6;

FIG. 8 is a side view, partly in section, showing position relationship of the cylinder case, rack and pivot elements;

FIG. 9 is a view taken on lines 9-9 of FIG. 8;

FIG. 10 is a view taken on lines 10-10 of FIG. 8;

FIGS. 11*a*-11*c* are like views showing adjustable backset to accommodate different width frames;

FIG. 12 is a perspective view of a screw holder;

FIG. 13 is a frontal view of the FIG. 12 screw holder with assembled screw, attached to the lock case and cover elements;

FIG. 14 is a section taken on lines 14-14 of FIG. 13;

FIG. 15 is a view like FIG. 2, but showing inclusion of upper and lower lock bolt components;

FIG. 16 is an elevation showing inclusion of door structures, and associated upper and lower bolt connections;

FIG. 17 is an enlarged vertical elevation showing details of connection of an actuator to an upper rod that drives an upper bolt connection;

FIG. 18 is a section taken on lines 18-18 of FIG. 17;

FIG. 19 is an enlarged vertical elevation showing details of an upper bolt connected to a vertical actuator rod;

FIG. 20 is a horizontal section taken on lines 20-20 of FIG. 19;

FIG. 21 is a perspective view showing a lock bolt having a side roller to engage associated fixed structure, as the bolt is displaced;

FIG. 22 is a section taken on lines 22-22 of FIG. 21; and

FIG. 23 is a section taken on lines 23-23 of FIG. 21.

DETAILED DESCRIPTION

Figure 1:
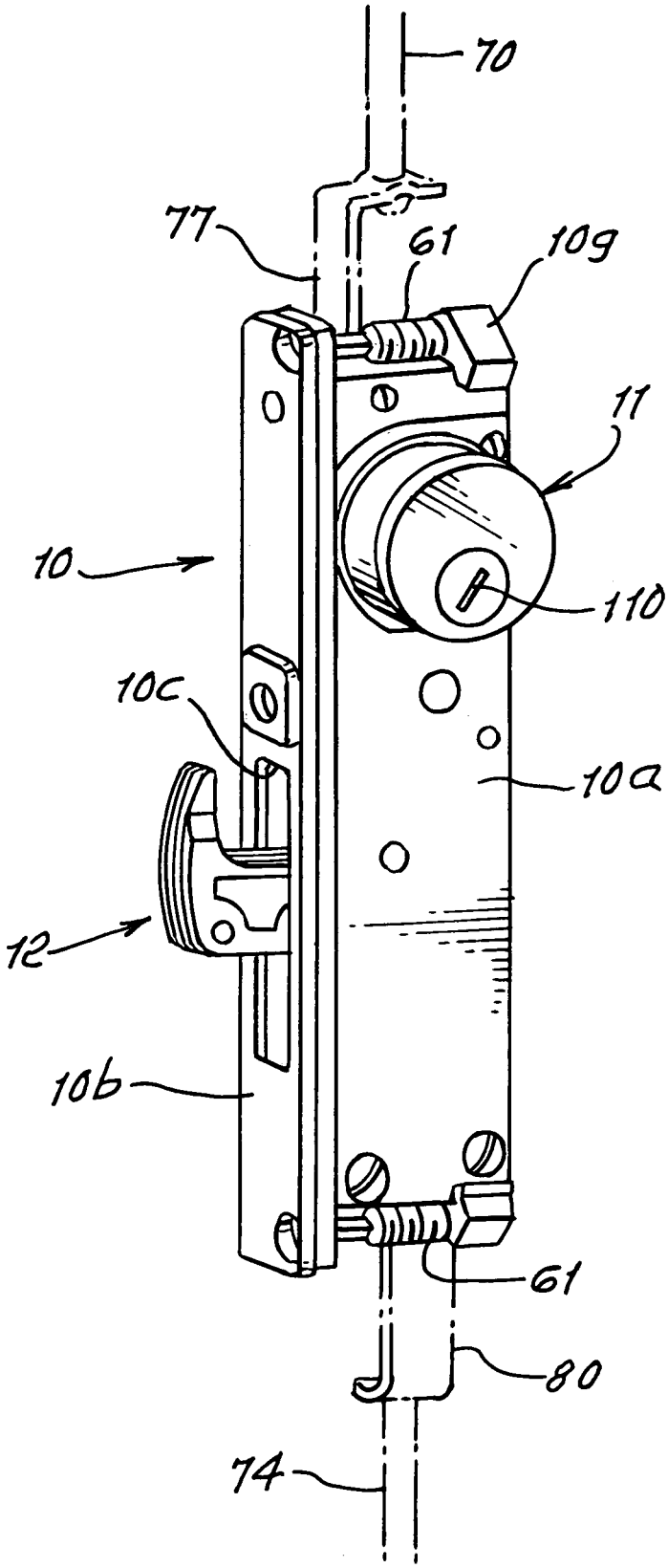
FIG. 1 is a perspective view of a preferred lock apparatus incorporating the invention.

In FIGS. 1 and 2, a door lock housing 10 carries a lock cylinder 11 projecting at one side 10*a* of the housing and bolt 12 projecting at side 10*b* of the housing, extending at 90° to side 10*a*. Within the housing is an upright lock case 14 defining a side opening 14*a* registering with side opening 10*c* of the housing. Bolt 12 in locked position projects laterally through the openings 14*a* and 10*c* as shown and is rotatable about pivot 15 in response to rotation of cylinder 11, as shown in FIG. 2. Cylinder 11 may be provided with a key entry slot 110, as shown.

Mechanism operable between cylinder 11 and the bolt 12 includes an elongated rack 16 driven endwise by a cam or dog 17 downwardly projecting from the cylinder 11 to engage rack projection 16*a* at the rack upper side. A pinion gear 18 is located below the rack, and has teeth 18*a* engaging downwardly projecting rack teeth 16*b*. A link or parallel links 19 are pivoted at 20 along with the gear 18, and located at opposite sides of the gear. The links and gear are fixedly attached to the supporting pivot shaft 20, whereby the gear 18 rotates the links. Shaft 20 is rotatable in frame bearings 21. Links 19 are rotatable between end position as seen in FIGS. 2 and 4, in which bolt 12 is extended, and position as seen in FIG. 3, in which the bolt has been rotated about pivot 15, into retracted position.

Pins 23 and 24 projecting from the sides of the bolt slidably fit in slots 23*a* and 24*a* of the links, to rotate the bolt, as the links are swung by the gear 18.

Figure 3:
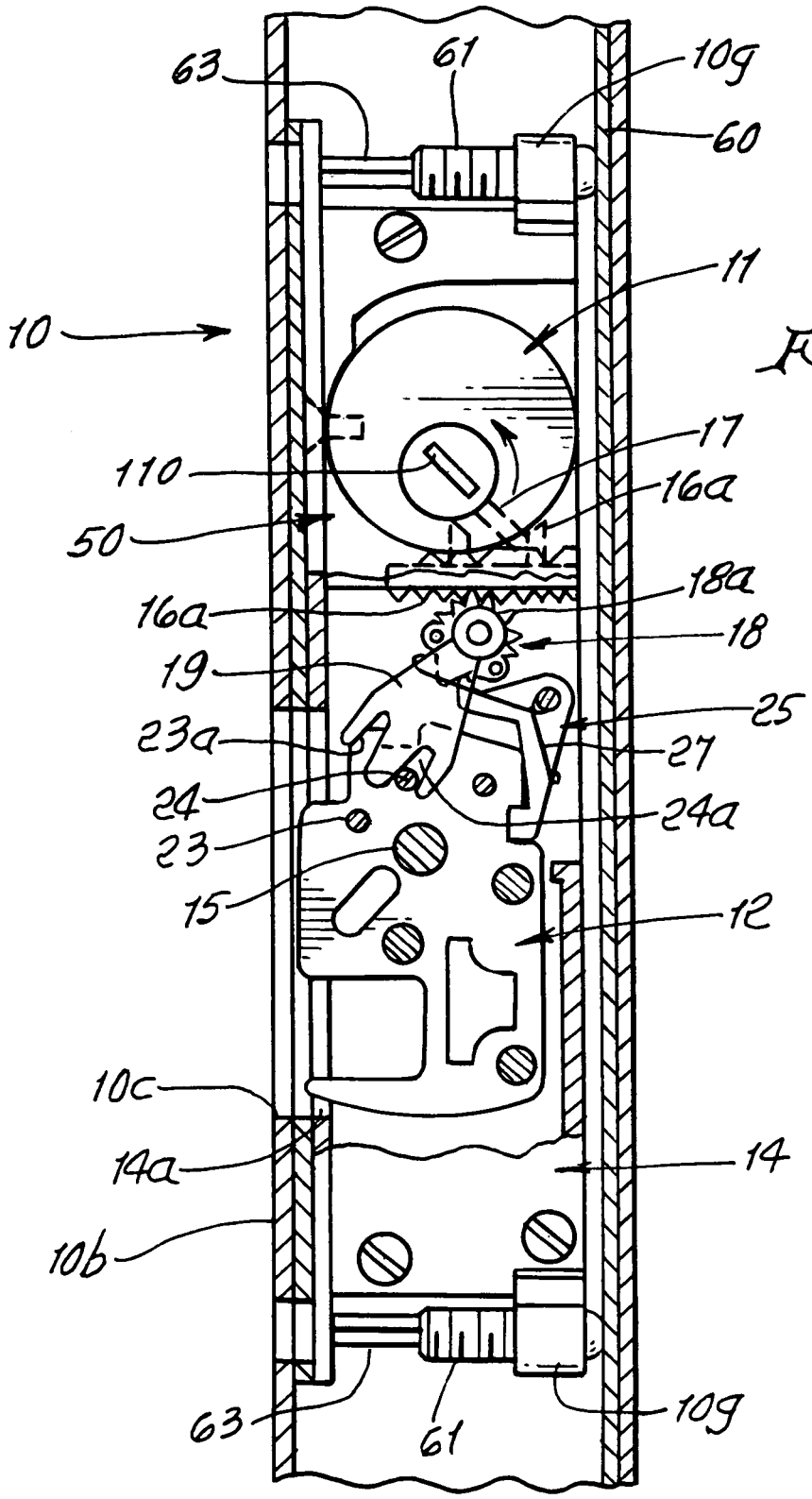
FIG. 3 is a view like FIG. 2, showing an unblocked condition.

A locking dog or lever 25, urged by a torsion spring 27 (see FIG. 4), has a terminal 25*a* that fits in a notch 26 in the bolt body 12*a* to lock the bolt in extended position, and the terminal 25*a* fits in a notch 95 in the bolt body 12*a* to lock the bolt in FIG. 3 retracted position. During bolt activation from the ends of bolt angular swing travel, the arm 24*c* of the dog is depressed by a projection 28 extending downwardly from the gear, to pivot the dog 25 and release terminal 25*a* from each notch, as the gear commences its rotation from each of the gear and bolt positions of FIGS. 3 and 4, toward alternate position. Lost motion, as provided as by slots 23*a* and 24*a*, allows release of the terminal 25*a* from each notch prior to activation of bolt swinging, to assure release. See in this regard pins 30*a* and 30*b* on gear 18 (see FIG. 5*a*) which engage opposite edges 19*a* and 19*b* of lever or link 19, after the gear 18 has rotated to pivot dog 25 enough to release terminal 25*a* from either snotch 26 and 95. Accordingly, gear 18 has multiple actuating functions which it controls.

Figure 5:
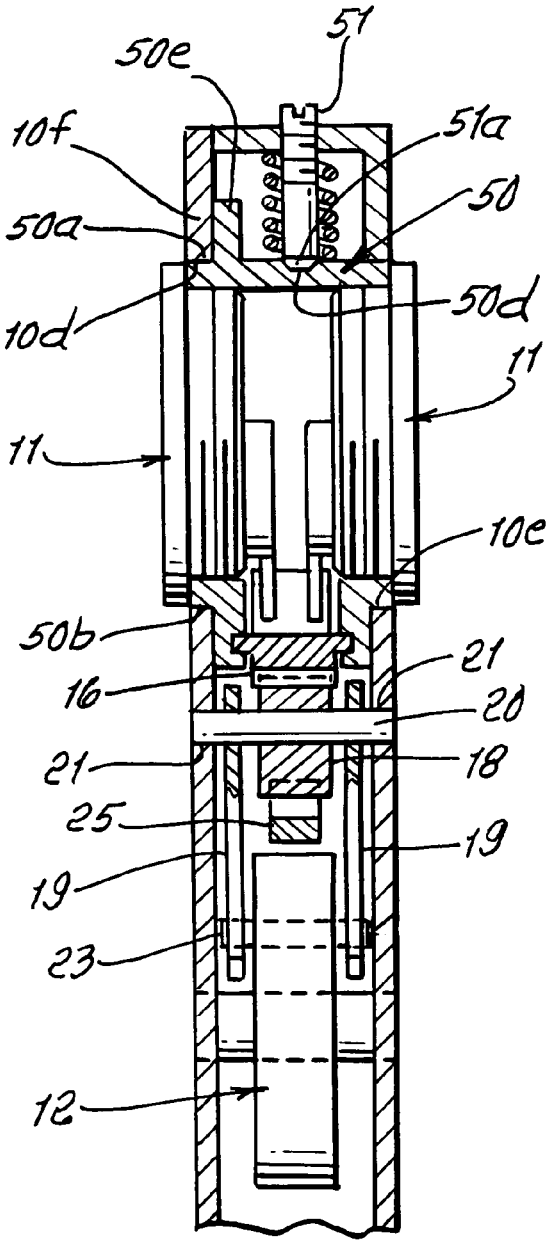
FIG. 5 is a vertical section taken on lines 5-5 of FIG. 4.

FIGS. 5-7 show the block-like casing 50 that receives the lock cylinder 11, and is installable in the frame or housing 10 to accurately position the cylinder 11 for rotation to actuate the rack 16. That casing 50 has upper and lower flat surfaces 50*a* and 50*b* that are to be retained between frame shoulders 10*d* and 10*e*, as seen in FIG. 5. A positioning screw 51 is adjustable to retain the casing 50 in position, the screw terminal 51*a* bearing on the case at 50*d*. Flange 50*e* bears against wall 10*f*. See also FIGS. 8-10, and FIGS. 11*a*-11*c*, which also show a first mating feature, such as grooves 52-54 in the casing and horizontally spaced apart, as shown, to adjust the horizontal position (backset adjustment) of the lock cylinder, as related to a door opening that receives the cylinder 11. A second mating feature, such as tongue l1*b* on the casing 50 projects downwardly to selectively fit into one of such grooves 52-54. Accordingly, a first set of tongue or groove elements is provided at the door opening, and which are horizontally spaced, and at least one tongue or groove element or elements is carried by the cylinder casing or door opening, to selectively interfit a groove or tongue element of said first set. FIGS. 11*a*-11*c*show accommodation to frames 1, 2 and 3 of different widths.

FIGS. 12-14 show provision of a means for retaining the lock housing or frame 10 in an adjusted horizontal position relative to an upright door stile 60 that receives that housing. The frame has a portion 10*d* that threadably receives, at 10*g*, a spacer or pusher 61 endwise bearing endwise against the inner side 60*c* of vertical door stile 60. An adjuster 63 projects into the screw interior, with hexagonal interfit, so that as the adjuster is rotated, the screw tightens endwise against surface 60*c*, and simultaneously adjusts the position of the frame 10, horizontally, relative to the stile. The thin endwise elongated adjuster may be inserted into the lock frame via a suitable small opening in the frame wall.

FIGS. 15-20 show provision of means to adjustably bolt connect the lock housing to structure immediately above and below the door frame, and to be actuated in response to bolt 12 rotation to lock the door. Upper vertical rod 70 is displaced upwardly in response to bolt 12 rotation, to urge upper bolt 71 into a recess 72 in door upper frame structure 73; and lower vertical rod 74 is displaced downwardly in response to said bolt rotation, which locks the door. Rod 70 is operatively connected, at 76 to an upper intermediate rod 77 which extends downwardly within the lock housing and into a recess 78 in the bolt 12, to be urged upwardly as the bolt rotates clockwise in FIG. 15; and rod 74 is operatively connected at 79 to a lower intermediate rod 80, which extends upwardly into the lock housing and has an interfit connection at 81 with the bolt, to be urged downwardly as the bolt rotates clockwise. Connection 76 is preferably a "quick release" connection to be made up after installation of the lock in door stile 60. FIGS. 17 and 18 show a spring 84 on rod 70 as compressed between a pin 85 on lateral extension 77a of rod 77, and a pin 86 on rod 70. Spring 84 stiffens the connection.

FIGS. 19 and 20 show a rotary adjustment means for positioning an auxiliary bolt 71 relative to a connecting door frame 90, having bracket flanges 90*a* and 90*b*. The upper end 70*b* of rod 70 is adjustment threaded into bolt lower structure 71*b*, whereby as rod 70 is adjustably rotated, the bolt is raised or lowered. An adjustable side fastener 93 engages a flat 94 on structure 71*b*, to keep that structure from rotating, once it has been adjusted. In FIG. 18, pins 85 on rod 70 release from grooves in 77*b* upon 90° rotation of 70, to "quick release" the connection.

FIGS. 21-23 show details of the bolt structure, including the through opening 150, and the roller 151, received in that opening to protrude at opposite sides of the bolt body 152, i) for rollable engagement with a confinement surface or surfaces associated with the casing, ii) or, for engagement by a hack saw operated by an intruder, for blocking severing of the bolt.

Laminations 153 form the bolt body and the opening 150. The roller may consist of ceramic material to resist lack saw teeth penetration. Cylindrical roller trunnions appear at 154.

What is claimed is:

1. A door lock for selectively locking a door to a door frame, the door lock comprising:

a) a lock case, b) a lock bolt pivotally coupled to the lock case about a first axis, the lock bolt configured for being selectively positioned in an extended position for placing the door in a locked position relative to the door frame, and a retracted position for placing the door in an unlocked position relative to the door frame, c) a rotary cylinder pivotally coupled to the lock case, d) an elongated rack driven endwise in response to pivotal rotation of the rotary cylinder, e) a gear pivotally coupled to the lock case, the gear rotatable by the driven rack, f) at least one bolt release link pivotally coupled to the lock case about a second axis and coupled with the gear, wherein rotation of the gear moves the at least one bolt release link between first and second angular positions relative to the lock case, wherein the at least one bolt release link positions the lock bolt to the extended position when in the first angular position, and positions the lock bolt to the retracted position when in the second angular position, and wherein the first axis is different than the second axis.

2. A door lock in accordance with claim 1 wherein the lock bolt has a through opening, and a roller received in the through opening to protrude at opposite sides of the lock bolt for rollable engagement with one or more confinement surfaces associated with the lock case.

3. A door lock in accordance with claim 1 including:

a cylinder casing configured for receiving the rotary cylinder and configured to fit in a door opening, and a first mating feature on the cylinder casing and configured for being selectively positioned within a second mating feature defined in the door opening, wherein the first and second mating features retain the cylinder casing in any of plurality of selected horizontal positions in the door opening.

4. A door lock of claim 3, wherein the first mating feature is one of at least one tongue or at least two grooves, and wherein the second mating feature is the other of the at least one tongue or at least two grooves.

5. A door lock in accordance with claim 1 including:

upper and lower elongated rod elements extending into the lock casing to be operatively connected to the lock bolt for extension into the door frame as the lock bolt rotates to the extended position, upper and lower auxiliary bolts operatively connected to an end portion of the upper and lower elongated rod elements, respectively, to be displaced into the door frame as the lock bolt rotates to the extended position, and an adjustment mechanism coupled with the upper auxiliary bolt to provide vertical adjustment of the upper auxiliary bolt relative to the upper elongated rod element.

6. A door lock of claim 1, further comprising a lock dog pivotally coupled with the lock case, the lock dog adapted to engage the lock bolt for releasably retaining the lock bolt in the extended and retracted positions.

7. A door lock of claim 6, wherein the lock dog is positioned for selective engagement with the gear to release the engagement of the lock dog and the lock bolt.

8. A door lock of claim 6, wherein the lock dog is pivotally coupled to the lock housing about a third axis, and wherein the first axis, the second axis, and the third axis are all different axes.

9. A door lock in accordance with claim 7 further including a spring biasing the lock dog toward retaining the lock bolt in the extended and retracted positions.

10. A door lock of claim 1, wherein the gear is pivotally coupled to the lock case about the second axis.

11. A door lock of claim 1, wherein the at least one bolt release link includes a first slot and a second slot defined therein, wherein the first and second slots are configured for receiving first and second pins, respectively, extending from the lock bolt, wherein the first pin is positioned in the first slot when the at least one bolt release link is in the first angular position, and wherein the second pin is positioned in the second slot when the at least one bolt release link is in the second angular position.

12. A door lock for selectively locking a door to a door frame, the door lock comprising:

a) a lock case, b) a lock bolt pivotally coupled to the lock case about a first axis, the lock bolt configured for being selectively positioned in an extended position for placing the door in a locked position relative to the door frame, and a retracted position for placing the door in an unlocked position relative to the door frame, c) a rotary cylinder pivotally coupled to the lock case, d) an elongated rack driven endwise in response to pivotal rotation of the rotary cylinder, ) a gear pivotally coupled to the lock case, the gear rotatable by the driven rack, f) at least one bolt release link pivotally coupled to the lock case about a second axis and coupled with the gear, wherein rotation of the gear moves the at least one bolt release link, and wherein the first axis is different than the second axis.

* * * * *